United States Patent [19]

Dauser, Jr.

[11] 4,446,332

[45] * May 1, 1984

[54] WIRE CONNECTOR

[75] Inventor: William C. Dauser, Jr., North Muskegon, Mich.

[73] Assignee: Lloyd A. Heneveld, Grand Rapids, Mich. ; Trustee of Dauser Trust IV— Solderless Connector

[ * ] Notice: The portion of the term of this patent subsequent to Oct. 13, 1998 has been disclaimed.

[21] Appl. No.: 301,765

[22] Filed: Sep. 14, 1981

Related U.S. Application Data

[63] Continuation-in-part of Ser. No. 99,624, Dec. 3, 1979.

[51] Int. Cl.[3] ..... H01R 11/00

[52] U.S. Cl. ..... 174/87; 339/98

[58] Field of Search ..... 174/84 S, 87, 88 S; 339/96, 97 R, 98, 99 R

[56] References Cited

U.S. PATENT DOCUMENTS 3,012,219 12/1961 Levin et al. ..... 339/98

3,388,370 6/1968 Elm ..... 339/98

*Primary Examiner*—Roy N. Envall, Jr.

*Attorney, Agent, or Firm*—Price, Heneveld, Huizenga & Cooper

[57] ABSTRACT

A solderless connector for insulation coated wire conductors includes an elongated nonconductive body member having a plurality of conductor receiving channels formed along its length. A support member including an annular conductive member is adapted for positioning over the elongated body and the channels. When the support member is pressed on the elongated body with wire conductors positioned in the channels, the annular conductive member engages a portion of the insulation on the conductor, removing the insulation therefrom, engages the wire to provide an electrical connection therewith.

11 Claims, 12 Drawing Figures

WIRE CONNECTOR

CROSS REFERENCE TO RELATED APPLICATION

This application is a continuation-in-part of application Ser. No. 99,624 filed Dec. 3, 1979 by applicant herein and entitled WIRE CONNECTOR.

BACKGROUND OF THE DISCLOSURE

This invention relates to electrical connectors and more particularly solderless electrical connectors such as those used for connecting insulated electrical wiring in commercial and residential electrical applications. The apparatus may also be used for the connection of wires in telephone and other electrical circuits.

In electrical wiring systems, it is necessary to join wires together in the various junction boxes, outlet boxes, utility boxes, switch boxes, lighting fixtures and the like commonly found in wiring systems.

In the past, the insulation was removed from the wire exposing the wire conductor and the joining of the wires was accomplished by soldering the wires together and taping with an insulating electrical tape.

Subsequently, solderless connectors of the type having a threaded metal insert molded into an insulated shell were developed. The connector was screwed on to the ends of the wires to be joined after a portion of the insulation was removed and the wires were twisted together in the connector. Other types of wire connectors included a housing having a removable metal insert, the insert having a set screw which when tightened, engaged the stripped wires. These and other known solderless connectors required that the insulation on the wire conductor be removed or stripped exposing the conductor to the metallic insert so as to obtain a metal-to-metal contact such that the wires were electrically connected. Examples of such previous wire connectors are shown, for example, in U.S. Pat. No. 2,036,561, issued Apr. 7, 1936 to S. R. Barrett; U.S. Pat. No. 2,123,070, issued July 5, 1938 to J. H. Van Viersen; and U.S. Pat. No. 2,416,943, issued Mar. 4, 1937 to J. Nicolazzo.

Subsequently, wire connecting devices were proposed which included a conductive cutting element fixed to an insulated threaded element which was received in an insulated body. The body included a cavity to receive insulated wires and a threaded opening to receive the threaded element. The wires and the cutting element were positioned perpendicular with respect to each other such that when the threaded element containing the cutter engaged and cut through the insulation and into the wires, electrical contact was made. A connector of this type of insulation cutter is shown, for example, in U.S. Pat. No. 3,487,354, issued Dec. 30, 1969 to Alfred E. Duncan.

Another type of insulation cutting apparatus is shown in U.S. Pat. No. 3,579,172, issued May 18, 1971 to Marvin A. Clark. In the Clark patent, a nonconductive body member is threaded and adapted to receive at least a pair of insulated wires. A conductive threaded member having a relatively deep and sharpened V-shaped threaded portion, cuts through the insulation and cuts slightly into the wire as the threaded member is turned into the body.

It will be noted, however, that in each of the above-mentioned solderless connectors, it is required that either the wire be stripped, that is, the insulation removed before a connection is made, or that the insulation is cut when the connector is operated to make the connection as the cutter is engaged or the threaded portion cuts through the insulation. Insulation cutting only is achieved and in no case is an actual stripping operation performed on the insulative sheath around the wire conductor to expose a surface of the wire. Thus, only limited point contact is made between the conductive member and the wire.

SUMMARY OF THE INVENTION

The present invention improves upon the prior art in its provision of an insulation stripping solderless connector which both removes a portion of the insulation and provides a large contact area with the wire to provide a superior electrical connection. The connector includes an elongated body of nonconductive material having a plurality of conductor receiving channels formed along its length. At one end of the body, the channels are tapered slightly inwardly toward the center of the body and are provided with serrated portions to engage the insulation and hold the conductor in position. An annular skirt surrounds the elongated body and has an annular receiving channel formed therein adjacent the body. An annular ring-like conductive element is adapted for positioning over the elongated body at the tapered end and is slidable along the body toward the skirt. The conductive element is adapted to engage, cut and strip the insulation on a conductor positioned in the wire receiving channels while it is moved along the body and engages the exposed wire conductors to electrically connect them together. The ring-like conductive element is carried by a nonconductive cap member which includes surfaces which mate with corresponding surfaces on the skirt such that when the cap and skirt are pressed together on the elongated body, a sealing relationship exists which encapsulates the conductive member and the wires positioned therein.

BRIEF DESCRIPTION OF THE DRAWINGS

The invention as well as the many important features thereof will become readily understood with reference to the following specification and accompanying drawings in which.

DESCRIPTION OF THE PREFERRED EMBODIMENT

Figure 1:
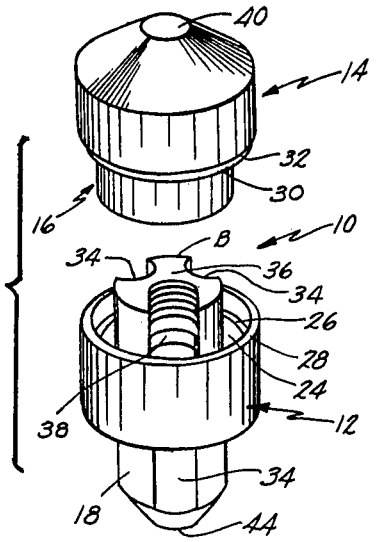
FIG. 1 is an exploded perspective view of the insulation stripping solderless connector of the invention.
Figure 6:
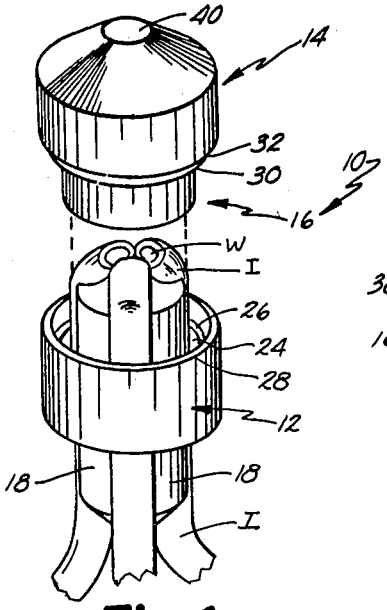
FIG. 6 is an exploded perspective view of the insulation stripping solderless connector of the invention having an insulated conductor inserted therein.

Referring to the drawings, a preferred embodiment of the invention is illustrated in detail. Basically, the wire connector of the invention, designated generally by the numeral 10 comprises three component parts, an elongated nonconductive body member 12 adapted to receive a plurality of insulated wires, a support or cap member 14 and a conductive insulation stripping, wire engaging, ring-like member 16.

Figure 2:
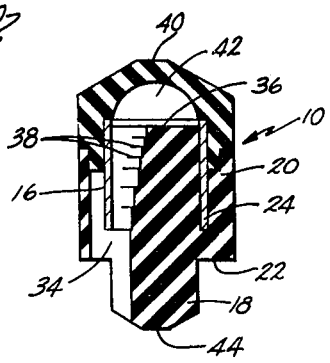
FIG. 2 is a cross-sectional view of the connector of FIG. 1 shown in an assembled condition.

With reference to FIGS. 1 and 2, body portion 12 and cap member 14 are preferably molded or otherwise formed from nonconductive material such as plastic, molded nylon or the like as for example glass-filled polyester, ABS, rigid PVC, polycarbonates and modified polyphenylene oxides. Body member 12 is molded to include an elongated center column 18 integrally formed with an annular surrounding skirt 20. Skirt 20 surrounding the column is connected thereto at a base portion 22 (FIG. 2) to thus form an annular well or recess 24 which as will be hereinafter described, receives the leading edge of the conductive stripping ring 16. At the upper extremity of the skirt, a pair of step-like flanges 26 and 28 are formed therein of increasing diameter to mate with corresponding annular step-like flanges 30 and 32, respectively, formed on the lower portion of cap member 14.

A plurality of conductor receiving channels 34 are molded along the length of center column 18. The conductor receiving channels or slots begin at the lower portion of the column, extend through base 22 of skirt 20 to the top of the body member. The slots are generally annular in configuration and in a preferred embodiment are equal to approximately one-half the diameter of a circle such that when an insulated conductor I (FIG. 4A) is positioned therein, the center of the conductor, i.e., the wire W is positioned approximately at the center of the recess 24 so as to be generally in line with the conductive ring 16 as will be hereinafter described. The channels 34 extend upwardly along the length of column 18 and through base 22 of skirt 20 where the channels begin to taper inwardly toward the top of the column. Notches or serrations 38 are formed in the upwardly inwardly tapered portion of channels 34 at the upper end of the column to engage the insulation on the conductor and to prevent the conductor from sliding out of the channel when the actual connection is made. The serrations also serve to eliminate the possibility of the conductor pulling out of the connector once a connection is made. Although three equally spaced channels are shown in the illustrated embodiment, it will be understood that any number of wire channels may be provided depending upon the number of wires to be connected.

Cap member 14 is also annular in configuration and includes the previously described annular flanges 30 and 32 formed along its lower extremity. The cap includes a frustroconical upper surface terminating in a flat portion 40. The inner portion of the cap is formed such that a recess 42 is provided between the inner top portion of the cap and top 36 of center column 18 when cap flanges 30 and 32 are in mating engagement with flanges 26 and 28 of skirt 20. It will also be noted that the lower end of center column 18 also terminates in a frustroconical configuration to provide a corresponding flat surface 44.

Insulation stripping ring 16 is an elongated annular member formed of conductive material as, for example, half hard brass, Phosphor Bronze, beryllium copper or the like. The outer diameter of ring 16 is press fitted into cap member 14 and is positioned so as to extend outwardly from the lower part of cap 14 and into recess 24 between center column 18 and skirt 20 when assembled. Ring 16 may be press fit into the central portion of cap 14 or alternately may be fixed to the cap during the molding operation. The inner diameter of ring 16 is such that it snugly fits about the outer diameter of central column 18. The upper end of column 18 is slightly tapered and has a somewhat reduced diameter toward the top portion 36 to receive the inner diameter of ring 16. The inner and outer diameters of the walls forming the annular well or recess 24 correspond closely to the inner and outer diameters of ring 16 to insure a close fit.

OPERATION

Figure 3:
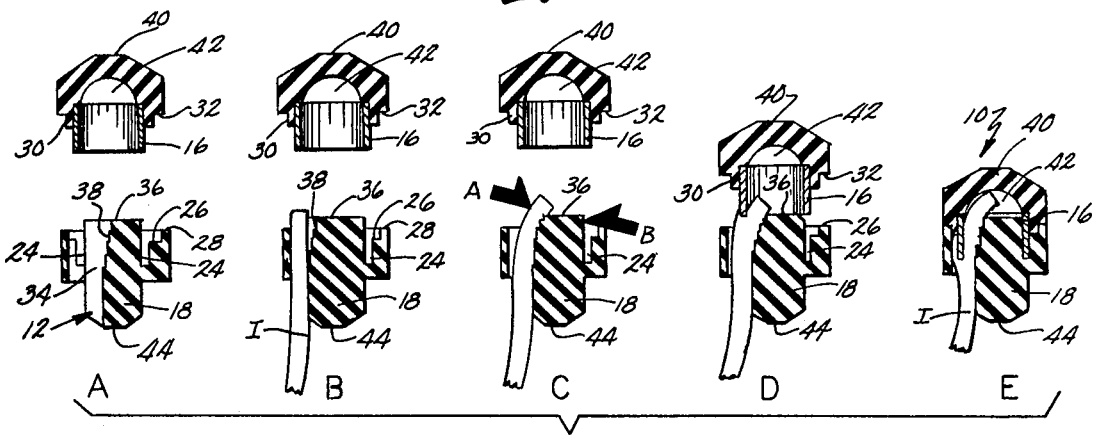
FIGS. 3A–3E are a series of cross-sectional views illustrating the progression of steps involved in making a connection.
Figure 4:
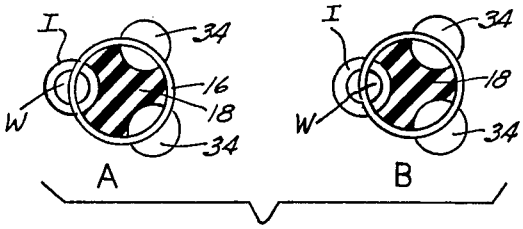
FIGS. 4A and 4B illustrate further the stripping action of the components of the connector.
Figure 5:
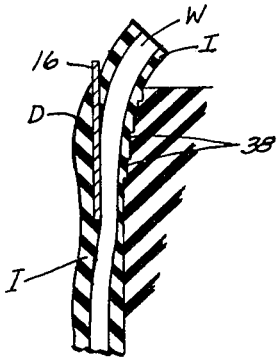
FIG. 5 is an enlarged view showing the contact between the stripping element and the wire conductor.
Figure 7:
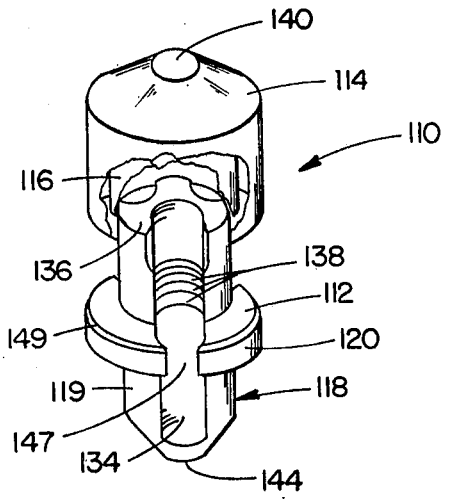
FIG. 7 is an exploded perspective view similar to FIG. 1 illustrating an alternate embodiment of the invention.

Referring now to FIGS. 3–5, the actual operation of the invention will be described in detail. The connector 10 including the base 12 and cap 14 with the ring 16 fixed therein are shown in FIG. 3A. Two or more insulated conductors I are positioned through the skirt such that the conductors lay in the wire receiving channels 34 along the length of column 18. The conductor is positioned to extend slightly above top 36 of center column 18 as illustrated in FIG. 3B. The conductors (see FIG. 3C) are bent slightly inwardly toward the center of the column. This may be accomplished by finger pressure or, depending upon the wire size, by exerting a slight pressure with the jaws of a pair of pliers, one jaw on the insulated conductor at the channel 34 and the other at the opposite side of the column as illustrated at points A and B of FIG. 3C. The several conductors I, one through each channel, are similarly inserted and bent slightly inwardly toward the center of the column.

Referring to FIG. 3D, cap 14 is positioned over the top of the column with the metal conductive ring 16 engaging and cutting into the insulation as shown at D. As the ring cuts through the wire, it peels the insulation away (see also FIG. 4B) and starts to engage the sidewall surface of the wire W. The jaws of a pair of pliers (not shown) are then positioned at top 40 of cap 14 and bottom 44 of column 18 and pressure is exerted to close the conductor. As the connector is closed, ring 16 continues to wipe the insulation from the wire and the ring moves into the recess 24 until the connector and wire is completely closed as illustrated in FIG. 3E and FIG. 5.

As illustrated in FIGS. 3E and 5, a substantial portion of the inner wall of ring 16 is in contact with the wire, and the insulation peeled away from the wire has moved into the opening formed through the skirt. The insulation on the wire facing the central column is somewhat compressed into serrations 38 of wire receiving channels 34. The insulation on the outside of the wire peeled by ring 16 is displaced outwardly to the outside diameter of the ring and toward the outer wall of recess 24. Some of the insulation flows downwardly and completely fills the wire receiving openings through skirt 24. Since the openings through the skirt are filled, a completely tight seal results such that moisture and other contaminates cannot enter into contact with the wire connection. Because of the pressure exerted and the superior wiping contact between the wire and the conductive ring, the wire is wiped completely clean and the degree of contact approaches that of molecular contact.

ALTERNATE EMBODIMENT OF THE INVENTION

An alternate embodiment of the invention as illustrated in FIGS. 7 through 12, wherein like or similar elements described in connection with FIGS. 1 through 6 are illustrated utilizing reference numerals bearing the prefix 100.

In this embodiment, the wire connector of the invention, designated generally by the numeral 110, includes three basic component parts: an elongated nonconductive body member 112 adapted to receive a plurality of insulated wires, a support or cap member 114, and a conductive, insulation stripping, wire engaging, ring like member 116. The body and cap members are preferably molded or otherwise formed from a nonconductive material such as that previously described in connection with the embodiment of FIGS. 1 through 6.

In this embodiment, body member 112 is molded to include an elongated center column 118 integrally formed with an annular surrounding skirt or flange 120.

A plurality of conductor receiving channels 134, are formed along the length of center column 118. The channels 134 extend upwardly along the length of column 118 through flange 120 and taper inwardly toward the uppermost or top portion of 136 of column 118. Notches or serrations 138 are formed in the upper inwardly directed, tapered portions of the channels 134 to engage the insulation on a conductor, preventing the conductor from sliding out of the channel when the actual connection is made. The lower end 119 of center column 118 terminates in a frustroconical configuration to provide a flat surface 144.

Figure 9:
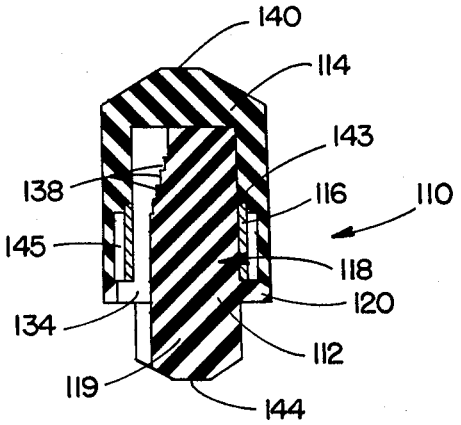
FIG. 9 is a cross-sectional view of the embodiment of the invention shown in FIGS. 7 and 8 and in a closed, conductor engaging position.
Figure 11:
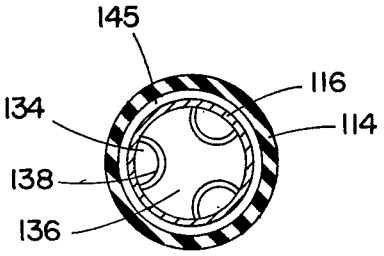
FIG. 11 is a cross-sectional view taken along the plane XI—XI of FIG. 8.

Support or cap member 114 is annular in configuration, having a frustroconical upper surface terminating in a flat surface 140. Cap member 114 is formed to receive and positively hold insulation stripping ring 116. Cap member 114 has an opening provided therein of varying diameters. The uppermost portion 142 is approximately the same diameter as the center column 18 and is provided, when the connector is closed, to receive the upper end portion 136 of center column 118 (FIG. 9). Opening 142 forms a recess above the insulation stripping ring 116. The diameter is slightly larger at stepped portion 143 to form a shoulder. The insulation stripping ring 116 is fixed in the stepped or shoulder portion of cap 114 and is and carried for movement with the cap 114 along center column 118.

A third enlarged portion 145 of the inner diameter opening of cap member 114 is spaced from and surrounds insulation stripping ring 116. The annular opening 145 formed between ring 116 and the side wall of cap 114 is provided to receive insulating material stripped from the insulated conductor.

The lower edge of cap 114 is chamfered or beveled as illustrated at 147 to mate with a corresponding surface 149 (FIGS. 7 and 8) provided on the upwardly facing surface of flange or skirt 120.

Figure 8:
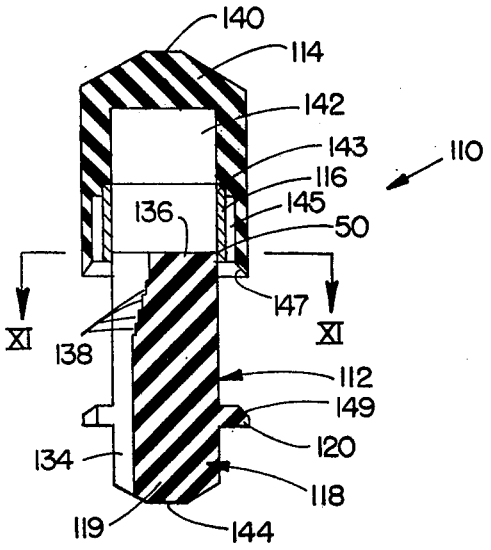
FIG. 8 is a cross-sectional view of the embodiment of FIG. 7 in an open, conductor receiving position.

The inner diameter of insulation stripping ring 116 corresponds generally to and snugly fits around the outer diameter of central column 118. The upper end 136 of column 118 may have a somewhat reduced diameter toward its top portion 136 to receive the inner diameter of ring 116. Preferably, the several components are packaged as an assembled unit, that is, central column 118, insulation stripping ring 116 and cap member 114 are provided as an internal unit and retained in the open position until actually used as illustrated in FIG. 8. That is, cap member 114 and stripping ring 116 carried thereby, are fixed in position near the uppermost end portion 136 of central column 118 and spaced from flange 120. When the components are assembled as illustrated in FIG. 8, they may be held in that position by a slight spot of adhesive 50 at the interface of the inner diameter of ring 116 and the outer diameter near the upper surface of center column 118. Alternately, the diameter of column 118 may be slightly increased just below top surface 136 such that a press fit relationship exists between center column 118 and stripping ring 116. In either event, the connector remains in the open position until such time as an external force is applied against ends 140 and 144.

The operation of this embodiment is similar to that previously described in connection with FIGS. 3A through 3D, 4 and 5.

Figure 10:
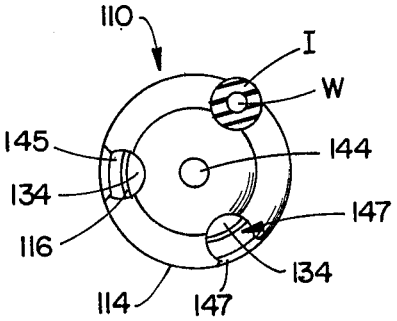
FIG. 10 is a bottom plan view of the connector of FIGS. 7, 8, and 9.
Figure 12:
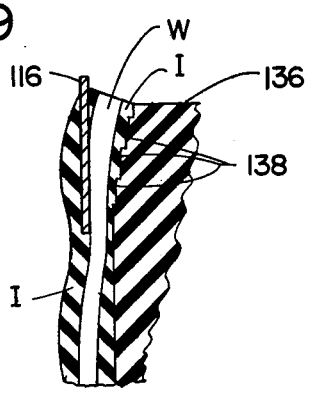
FIG. 12 is a view similar to FIG. 5 showing the contact made between the stripping element and wire conductor.

With reference additionally to FIGS. 10 and 12, a plurality of conductors I having insulation thereon are positioned in channels 134 to extend along column 118 and terminate near the upper surface 136. Channels 134 pass through flange 120 and the opening 147 therethrough (FIG. 10) such that the insulated conductor snaps into and is held in place by the material of the flange surrounding the wire. It will be noted that the entrance opening 147 (FIG. 7) to channel 134 at the outer diameter of flange 120 is slightly smaller than the opening of the channel. The opening through the flange or skirt 120 is such that the insulated wire is partially encompassed to provide a holding force. Preferably, channels 134 are annular in configuration and are equal to approximately one-half the diameter of a circle while the channels through flange 120 forming the access opening 147 through the flange to the channels is greater than one-half or approximately three-quarters diameter of a circle such that an insulated wire pressed therein is embraced by the surrounding material. After the wires are positioned along the channels and held in place, a force is applied at top 140 of cap 114 and bottom 144 of column 118 to close the connector causing it to assume the closed position shown in FIG. 9.

As the connector closes, ring 116 cuts through the insulation I (FIG. 12) and engages the wire W along a substantial portion of its length. The insulation on the wire facing the center column is somewhat compressed into the steps or serrations 138 while the portion peeled by ring 116 flows into the space 145 between ring 116 and the sidewall of cap 114.

As the connector portions assume the completely closed position shown in FIG. 9, the lowermost beveled portion 147 of cap 114 comes into mating engagement with the corresponding beveled portion 149 on flange 120 and a perfect and complete electrical connection is made.

The embodiments of the invention disclosed will accept at least four wire ranges, from 12 to 18 guage, either solid or stranded wire. The area of contact between the ring and wire is preferably equal to approximately 3½ times the cross-sectional area of a 12 guage wire, although this can be varied depending upon the particular requirements to be met.

It will be appreciated that any number of wire receiving channels may be provided depending upon the particular application. It is also possible to include channels of differing diameters for use in specialized applications where extremely large and extremely small diameters must be connected.

Those skilled in the art will readily appreciate that since it is not necessary to remove the insulation from the wire prior to making the connection, assembly time is much less than that required when using known connectors. The simple connector lends itself well to comparatively inexpensive injection molding techniques and in operation, a superior connection is provided. Since when the connection is made, the ring is moved along the length of the wire conductor, the possibility of cutting into the wire itself is eliminated. The connection, therefore, is readily useable with both solid and stranded wires. It will additionally be readily recognized that the base member and the cap member cooperate in a novel manner with the conductive element to provide a means for making rapid, reliable electrical connections with a minimum of effort. Since the cap and base are of molded construction and the conductive element does not require special treatment, the cost is significantly reduced from prior art connector devices. While the terms "ring-like" and "annular" have been used to describe various components of the connector, the terms are not intended to be used in a limiting sense, but rather are used to describe an object which is at least partially encompassing rather than completely encircling. It will be appreciated by those skilled in the art that different embodiments may be conceived and fabricated without departing from the scope of the invention as set forth in the appended claims.

The embodiments of the invention in which an exclusive property or privilege is claimed are defined as follows.

I claim:

1. A self-stripping solderless electrical connector comprising:

an elongated body of insulating material having wire receiving channels formed along at least a portion of its length for receiving electrical wire covered with insulation;

support means of insulating material having a conductive member fixed thereto, said support means and said conductive member being adapted for linear movement along a portion of said elongated body and said channels in response to a linear force directed along the elongated axis of said body, said conductive member adapted to engage a plurality of insulated wire conductors positioned in said channels, cut through the insulation thereof, and engage wire conductors to provide an electrical connection therebetween upon said movement of said support means and conductive member along said elongated body;

and means including releasable fixing means for attaching one end of said support means in a predetermined position on said body, in which position the channels each can receive a separate insulation covered, electrical wire before said movement of said support means and conductive member relative to said body; said fixing means being releasable in response to said linear force moving said support means and said conductive member.

2. The connector of claim 1 in which said channels are open and accessible from the side and holding means is located at each channel for embracing and holding an insulated electrical wire in each of said channels.

3. The connector of claims 1 or 2 in which the conductive member is a tube-like member of a size and shape to initially fit over said body with the insulation covered wires positioned in said channels and upon linear movable being adapted to cut into said insulation and engage the wire conductors.

4. The electrical connector of claims 1 or 2 in which the conductive member in the attached position on the body is located radially outwardly of said channels;

said channels being tapered radially outwardly from its attached end to its unattached end whereby said conductive member when forced in a linear direction over said wire conductors becomes unattached and cuts into the insulation of said conductors to engage the wire conductors.

5. A solderless self-stripping electrical connector comprising:

an elongated body portion forming a column having a first and second end and a plurality of channels along the exterior length thereof with surface areas between said channels, said channels each being adapted to separately receive an insulated wire conductor constructed of a conductor wire covered with insulation;

a cap member of insulating material having a conductive member with a first end fixed therein, said conductive member having a second end adapted to fit over the first end of said column;

said conductive member being a tube-like member having an inner wall defining an opening extending therethrough of the same configuration and size as said column except for said channels, thereby providing a snug interfit between said inner wall and said surface areas; said channels being increasingly greater in depth at said first end of said column than at said second end thereof whereby when said insulated wire conductors are inserted in said channels with an end extending beyond said first end of said column said tube-like member can be forced over the said first end of said column in a linear direction along the axis of said column while said insulated wire conductors are positioned in said channels;

said second end of said conductive member having a cutting edge whereby when a force is applied to said cap in said linear direction to force said conductive member over the said column, by reason of said snug interfit the said inner wall of said conductive member is guided by said surface areas causing said cutting edge to cut through the said insulation and causing said inner wall to physically contact the said conductor wires positioned within said channels.

6. The electrical connector of claim 5 in which the wire conductors are substantially cylindrically shaped.

7. The electrical conductor of claim 5 in which one of the body portion or cap member include a skirt surrounding said conductive member when said cap and conductive member has been moved to a position over said body in which the wire conductors are electrically connected together by said conductive member.

8. The electrical connector of claim 7 in which a flange extends from said body and cooperates with said skirt to substantially enclose the connections between said conductive member and said wire conductor.

9. The electrical connector of claim 5 in which the channels have serrations for holding the wire conductors therein when the conductive member is forced over the wire conductor and said body portion and as it cuts through the said insulation.

10. The electrical connector of claim 9 in which the flange and skirt are integrally formed on said body portion.

11. The electrical connector of claim 9 in which the said flange is formed on said body and the said skirt is formed on said cap.

* * * * *

UNITED STATES PATENT AND TRADEMARK OFFICE

CERTIFICATE OF CORRECTION

PATENT NO. : 4,446,332

DATED : May 1, 1984

INVENTOR(S) : William C. Dauser, Jr.

It is certified that error appears in the above-identified patent and that said Letters Patent is hereby corrected as shown below:

Col. 9, line 6;

"9" should be ---8---;

Col. 10, line 3;

"9" should be ---8---.

Signed and Sealed this

Sixth Day of November 1984

[SEAL]

*Attest:*

GERALD J. MOSSINGHOFF

*Attesting Officer*

*Commissioner of Patents and Trademarks*